United States Patent [19]

Hodgson

[11] Patent Number: 4,655,702

[45] Date of Patent: Apr. 7, 1987

[54] PRESS APPARATUS WITH ECCENTRIC CAM FOR COMPACTING WASTE SOAP

[76] Inventor: Patricia Hodgson, P.O. Box 10, Katrine, Ontario, Canada, P0A 1L0

[21] Appl. No.: 771,711

[22] Filed: Sep. 3, 1985

[51] Int. Cl.[4] ..... B30B 1/06

[52] U.S. Cl. ..... 425/318; 425/410

[58] Field of Search ..... 425/406, 410, 177, 318, 425/355, DIG. 35, DIG. 54, DIG. 128; 17/32, 76; 100/251, 274, 292; D15/123; 264/37, DIG. 69

[56] References Cited

U.S. PATENT DOCUMENTS

| | | | |
|---|---|---|---|
| 153,981 | 8/1874 | Dowers | 100/228 |
| 184,800 | 11/1876 | Sage | 100/231 |
| 4,035,122 | 7/1977 | Cavanaugh | 425/84 |
| 4,501,355 | 2/1985 | Hoffman | 206/77.1 |
| 4,548,572 | 10/1985 | Hoffman | 425/410 |

FOREIGN PATENT DOCUMENTS

| | | |
|---|---|---|
| 25730 | 1/1887 | Canada . |
| 55458 | 3/1897 | Canada . |
| 275187 | 11/1927 | Canada . |
| 717845 | 9/1965 | Canada . |

*Primary Examiner*—Jan Silbaugh
*Assistant Examiner*—Jennifer Cabaniss
*Attorney, Agent, or Firm*—Burke-Robertson, Chadwick & Ritchie

[57] ABSTRACT

A soap press for compressing soap pieces and forming a bar therefrom. The press comprises a press chamber which is secured in fixed relation to a shaft. The chamber receives the soap pieces and is formed by sides and removable top and bottom plates. The edges of the top plate are closely circumscribed during operation by the sides of the chamber. The top plate is movable within the chamber in a direction parallel to the walls thereof. The bottom plate is removably secured across the bottom of the chamber. The press further comprises means to apply pressure to the top plate of the chamber, which consists of an eccentric cam rotatable about an axis. The cam during operation bears against a portion of the top plate and as it rotates about its axis forces the top plate into the press chamber to a predetermined distance, to apply appropriate pressure to soap pieces within the chamber. The means to apply pressure is movable along the shaft from a first position such that the cam is spaced from the top plate allowing for the removal of said top plate, to a second position such that the cam comes into contact with the top plate. The soap press according to the present invention provides a simple, compact device, which is easy to use and may be, for example, affixed to a wall for domestic use.

10 Claims, 4 Drawing Figures

PRESS APPARATUS WITH ECCENTRIC CAM FOR COMPACTING WASTE SOAP

This invention relates to a device for molding pieces of soap into a bar, and more particularly to a press for making a bar of soap from waste pieces of soap.

BACKGROUND OF THE INVENTION

Presses for soap and other materials are known in the prior art. Canadian Patent No. 25,730 of Board issued Jan. 13, 1887 describes and illustrates a soap press which is operated by a foot lever and a counterpoise weight. This press comprises a chamber with a lever operated upper plate and spring mounted lower plate. The lever mechanism has several interacting mechanical components and is quite complex in construction and operation. Canadian Patent No. 55,458 of Field issued Mar. 29, 1897 describes a soap press comprising a piston slidable within a press chamber and means for sliding the piston consisting of a shaft and a crank handle. Canadian Patent Nos. 275,187 of Fisher, issued Nov. 8, 1927 and 717,845 of Hauf issued Sept. 14, 1965 describe and illustrate other constructions of presses and are of general background interest.

It is an object of the present invention to provide a device to compress waste pieces of soap into a normal size bar, which device may be attached, for example, to the wall of a bathroom. It is a further object of the present invention to provide such a device of simple construction and operation.

SUMMARY OF THE INVENTION

According to the present invention, there is provided a soap press for compressing soap pieces and forming a bar therefrom. It comprises a press chamber secured in fixed relation to a shaft. The chamber receives the soap pieces and is formed by sides and revovable top and bottom plates. The edges of the top plate are closely circumscribed during operation by the sides of the chamber. The top plate is movable within the chamber in a direction parallel to the walls thereof. The bottom plate is removable secured across the bottom of the chamber. A means to apply pressure to the top plate of the said chamber, consisting of an eccentric cam supported on a frame and rotatable with respect to the frame about an axis passing through the frame, and a binding means rigidly secured to the frame and movably secured to the shaft to maintain the frame at the same relative position on the shaft during each operation of the cam, is provided. During operation, the cam bears against a portion of the top plate and as it rotates about its axis, it forces the top plate into the press chamber to a predetermined distance to apply appropriate pressure to the soap pieces within the chamber. The binding means is movable along the shaft from a first position such that the cam is spaced from the top plate allowing for the removal of the top plate, to operative positions progressively lower on the shaft such that the cam comes into contact with the top plate to exert the desired amount of pressure on the plate. The cam is of a construction and shape such that, during operation, it bears against a portion of the top plate. With the binding means maintaining the cam and frame at the same vertical height, movement of the cam then effects downward pressure on the top plate and downward movement thereof on the soap pieces within the chamber a distance determined by the throw of the cam.

In a preferred embodiment of the invention, the binding means comprises a bearing rigidly secured to the frame and circumscribing and slidable along the shaft to grip the shaft to prevent an upward movement of the cam away from the top plate when the cam is moved while applying pressure to the top plate.

This invention has several advantages over the prior art. It is very compact and easy to use. Given its construction, it can easily be affixed to a wall. The present invention can also serve as a collector for soap pieces until enough have been collected to form a new bar since the press chamber has a removable top plate. The invention can also be used in the making of personalized soaps. The inside surface of the top plate of the device can be inscribed for example with the name of the owner of the press, thus yielding soaps stamped with the owner's name. The invention also allows for the addition of perfume to a soap or the combination of different brands of soap.

BRIEF DESCRIPTION OF THE DRAWINGS

These and other objects and advantages of the invention will become apparent upon reading the following detailed description and upon referring to the drawings in which.

Figure 1:
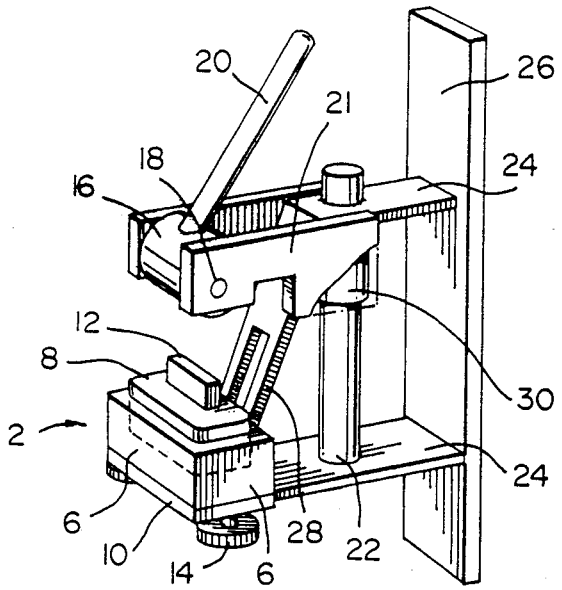
FIG. 1 is a perspective view of a soap press according to the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the drawings, similar features have been given similar reference numerals.

Figure 2:
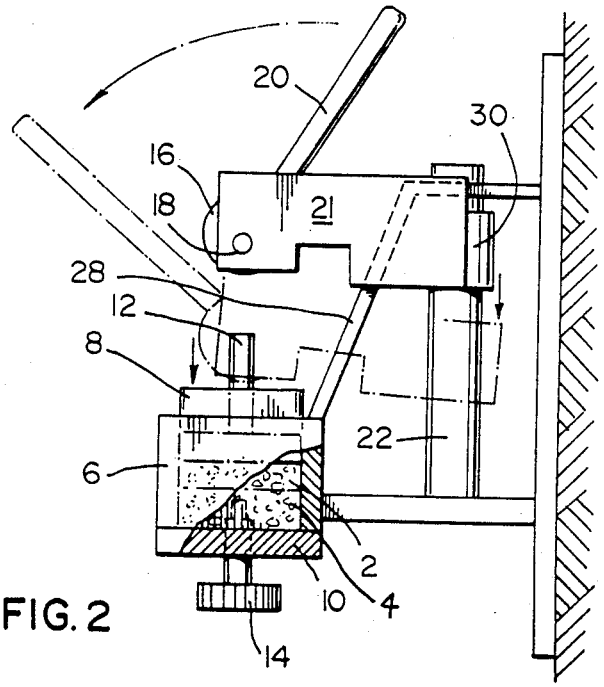
FIG. 2 is a side view of the press of FIG. 1.

Turning to FIG. 1 there is illustrated a soap press in accordance with the present invention having a press chamber 2 to receive within soap pieces 4. The chamber has sides 6, and removable top and bottom plates 8 and 10 respectively. The top plate 8 preferably has an upwardly projecting extension 12. The bottom plate 10 is attached to the press chamber 2 by releasably locking means which, in the described embodiment, are thumb screws 14 threaded into the bottom edges of a pair of sides 6 as illustrated (FIG. 2). Pressure is applied to the top plate 8 (and consequently soap pieces 4 within chamber 2) by means of an eccentric cam 16 which is rotatable about pivot point 18 by means of lever arm 20 fixed to a portion thereof. Cam 16 is pivotally secured to frame 21. That frame 21 is vertically movable along shaft 22 by means of back bearing 30 which is affixed to this frame and which circumscribes vertical shaft 22 in a manner which will be described hereinafter. Cam 16 is thereby movable from a first position, spaced from the upper part of extension 12 as shown in FIG. 2 to a second position such that the cam is in contact with this upper end of extension 12. The soap press has a backing or support member 26 with which it can be affixed to a surface, such as a bathroom wall. The vertical shaft 22 is secured in position, with respect to backing 26 and chamber 2 by way of upper and lower bars 24. A transverse guide bar 28 is connected between upper and lower bars 24 of the press chamber and to the vertical shaft 22 as illustrated (e.g. FIG. 2) to assist in guiding frame 21 and prevent its rotation with respect to shaft 22 as it moves along this shaft.

Figure 3:
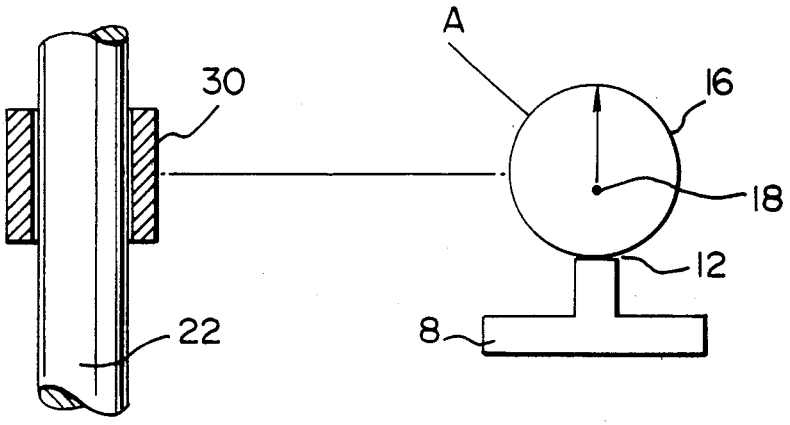
FIGS. 3*a* and 3*b* are schematic partial side views of the shaft and cam of the soap press, respectively in operational and non-operational positions, illustrating certain aspects of operation of the device.
Figure 3A:
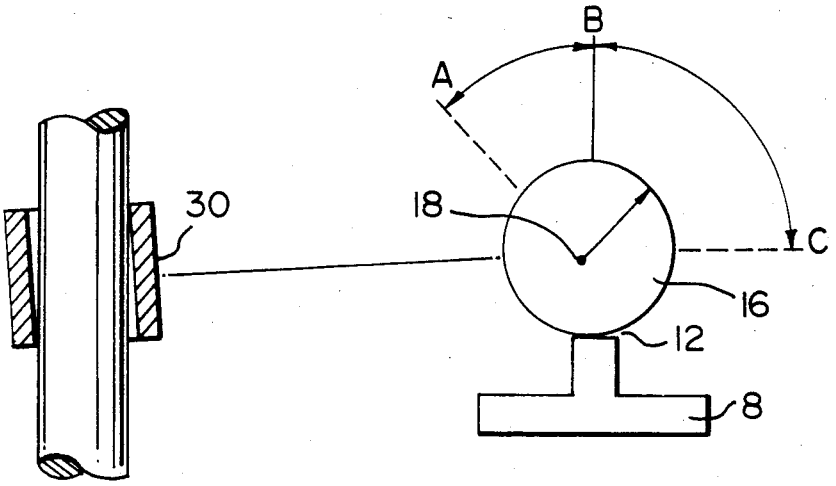

As shown best in FIGS. 3*a* and 3*b*, back bearing 30 loosely circumscribes vertical shaft 22 and is slidable with respect thereto. In operation, back bearing 30 is designed to prevent an upward vertical movement of the cam 16 when lever arm 20 is moved to pivot cam 16, by gripping the shaft (FIG. 3*a*). When cam 16 is moved from its first position spaced from the upper end of upper plate projection 12, into second position such that it comes into contact with the top plate, the surface of the cam which is closest to pivot 18 is intended to make contact with this upper part of extension 12 (FIG. 3). Lever arm 20 is then moved to rotate cam 16 about pivot point 18 (FIG. 3*a* of position B), and thereby slide a portion of its peripheral surface which is spaced a greater distance from pivot point 18 to bear against the upper part of extension 12. Back bearing 30 is thereby caused to twist, as illustrated in FIG. 3*a*, and bind in that position on shaft 22 as illustrated, while force is being applied on plate 8. This prevents an upward vertical movement of cam 16 with respect to extension 12 and upper plate 8 while that force is being applied. As cam 16 is maintained at the same vertical height on shaft 22, downward pressure on upper plate 8 and downward movement thereof on soap chips 4 within chamber 2 are effected as the lever arm is moved to position C (FIG. 3*a*). Top plate 8 is thereby pressed down into the press chamber to a distance determined by the throw of the cam. Lever arm is then returned to its original position. This returns back bearing 30 to the sliding position of FIG. 3, freeing it to slide further down shaft 22 to a distance determined by the previous downward movement of top plate 8. The procedure is then repeated until the soap pieces have been compressed into a bar. The lever arm 20 and frame 21 may then be returned to their first position.

In operation, pieces of soap 4 are collected in press chamber 2 with bottom plate 10 in place and top plate 8 removed. When the chamber 2 is filled to an appropriate level with soap, the top plate 8 is put into place, and pressure is applied to that plate by cam 16 as previously described herein. The top and bottom plates are preferably first slightly smeared with petroleum jelly to prevent soap from sticking.

When the pressing operation is completed, thumb screws 14 are unscrewed and the bottom plate is removed. Lever arm 20, by a further turn, causes the bar of soap to emerge from the bottom of the chamber with the top plate attached thereto.

In operation, the device according to the present invention compresses soap in chamber 2 sufficiently to displace air pockets and cause pieces of soap to take the shape of the volume left in the chamber. A pressure of 1800 psi can be achieved in the chamber with a 50 pound force on lever arm 20, in the embodiment illustrated. In a prototype device of this type, a 250 to 1 mechanical advantage over the soap in the chamber has been readily achieved. This is more than sufficient pressure to mold even dried up soap, since normally a 30 pound force effecting a pressure of 1070 psi is all that is needed in this regard. In this manner the individual pieces of soap are bonded together, the surface tension of the individual pieces of soap being broken down and the polymer structure of the soap pieces being joined together to form a homegeneous mass.

Of course, as previously mentioned, the inner surface of upper plate 8 may be engraved to provide a name or design, thereby forming a predetermined impression on the soap product produced.

Thus it is apparent that there has been provided in accordance with the invention a soap bar forming device that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A soap press for compressing soap pieces and forming a bar therefrom, comprising a press chamber secured in fixed relation to a shaft, the chamber to receive the soap pieces and formed by sides and removable top and bottom plates, the edges of the top plate being closely circumscribed during operation by the sides of the chamber, the top plate being movable within the chamber in a direction parallel to the sides thereof, and the bottom plate being removably secured across the bottom of the chamber, means to apply pressure to the top plate of said chamber consisting of an eccentric cam supported on a frame and rotatable with respect to the frame about an axis passing through the frame, and binding means rigidly secured to the frame and movably secured to the shaft to maintain the frame at the same relative position on the shaft during each operation of the cam, said binding means being movable along the shaft from a first position such that the cam is spaced from the top plate allowing for the removal of said top plate to operative positions, progressively lower on the shaft such that the cam comes into contact with the top plate to exert the desired amount of pressure thereon, said cam of a construction and shape such that during operation it bears against a portion of the top plate, and with the binding means maintaining the cam and frame at the same vertical height, movement of the cam effects downward pressure on the top plate and downward movement thereof on the soap pieces within the chamber a distance determined by throw of the cam.

2. A device as claimed in claim 1 wherein the binding means comprises a bearing rigidly secured to the frame and circumscribing and slidable along the shaft, said bearing gripping the shaft to prevent an upward movement of the cam away from the top plate when the cam is rotated while applying pressure to the top plate.

3. A device as claimed in claim 2, wherein the shaft is connected to the said chamber by a bar normal to the shaft.

4. A soap press according to claim 2 wherein a guide means is secured to the shaft to cooperate with the frame to maintain, during operation, proper positioning of the cam with respect to the top plate.

5. A device as claimed in claim 1 wherein the outer edges of the bottom plate overlap bottom edges of the sides of the press chamber and the said plate is releasably attached to the press chamber by releasable locking means.

6. A device as claimed in claim 5 wherein the bottom plate is attached to the press chamber by means of thumb screws.

7. A device as claimed in claim 1 wherein the cam during operation bears against an upward extension from the top plate, said extension being located at the center of the plate.

8. A device as claimed in claim 1 wherein the cam is rotated by means of lever arm secured thereto.

9. A soap press for compressing soap pieces and forming a bar therefrom, comprising a press chamber secured in fixed relation to a shaft, the chamber to receive the soap pieces and formed by sides and removable top and bottom plates, the edges of the top plate being closely circumscribed during operation by the sides of the chamber, the top plate being movable within the chamber in a direction parallel to the walls thereof and the bottom plate being removably secured across the bottom of the chamber, the outer edges of the bottom plate overlapping the bottom edges of the sides of the press chamber, the said bottom plate being attached to the press chamber by releasable locking means, the press further comprising means to apply pressure to the top plate of the said chamber consisting of an eccentric cam rotatable about an axis and mechanically associated with a lever arm, said cam during operation bearing against a portion of the top plate and as it rotates about its axis forcing the top plate into press chamber to a desired distance and applying pressure to soap pieces within the chamber, said means to apply pressure being movable along the shaft from a first position such that the cam is spaced from the top plate allowing for the removal of the said top plate to a second position such that the cam comes into contact with the top plate.

10. A soap press according to claim 9 comprising a bearing rigidly secured to the frame and circumscribing and slidable along the shaft, said bearing gripping the shaft to prevent an upward movement of the cam away from the top plate when the cam is moved while applying pressure to the top plate.

* * * * *